US005771604A

United States Patent [19]

Wunderlich et al.

[11] Patent Number: 5,771,604

[45] Date of Patent: Jun. 30, 1998

[54] CLOTHES DRYER AIR INLET ARRANGEMENT

[75] Inventors: Daniel F. Wunderlich; Kirk M. Dunsbergen, both of Newton, Iowa

[73] Assignee: Maytag Corporation, Newton, Iowa

[21] Appl. No.: 834,905

[22] Filed: Apr. 7, 1997

[51] Int. Cl.[6] ..... F26B 11/02

[52] U.S. Cl. ..... 34/603; 34/608

[58] Field of Search ..... 34/602, 603, 604, 34/606, 608; 99/409, 427, 443 R, 447

[56] References Cited

U.S. PATENT DOCUMENTS

| | | | |
|---|---|---|---|
| 2,651,113 | 9/1953 | Milby et al. | 34/604 X |
| 2,655,735 | 10/1953 | Traube | 34/604 |
| 2,798,307 | 7/1957 | Reiter | 34/133 |
| 2,818,659 | 1/1958 | Hague | 34/602 X |
| 2,961,776 | 11/1960 | Hughes | 34/133 |
| 3,060,593 | 10/1962 | Flora et al. | 34/133 |
| 3,750,304 | 8/1973 | Ghadiali | 34/566 |
| 4,019,023 | 4/1977 | Marzonie et al. | 219/400 |
| 4,854,054 | 8/1989 | Johnson | 34/133 |
| 5,196,444 | 3/1993 | Bar-Sheshet | 34/606 X |

*Primary Examiner*—Henry A. Bennett
*Assistant Examiner*—Steve Gravini
*Attorney, Agent, or Firm*—Zarley, McKee, Thomte, Voorhees, & Sease

[57] ABSTRACT

An air inlet arrangement is provided in a laundry dryer for enhanced drying efficiency and rate. The dryer includes a drum with a rotating sidewall and a stationary rear bulkhead sealingly engaging the sidewall. A heater is provided on the outside of the rear bulkhead. The rear bulkhead includes a generally horizontally disposed air inlet in its lower half for introducing heated air into the drum. The heated air stream includes a hot inner core and a cool outer envelope so as to minimize the surface temperatures of the bulkhead and the sidewall and thereby prevent heat damage to clothing and laundry in the drum. The rear bulkhead includes a spirally ramped forward surface along which the air travels to impart a spiral airflow through the drum, thereby enhancing heat transfer between the air and the laundry in the drum.

24 Claims, 4 Drawing Sheets

CLOTHES DRYER AIR INLET ARRANGEMENT

BACKGROUND OF THE INVENTION

Conventional laundry dryers include a cabinet with a rotating drum mounted therein. Typically, the drum includes an opening in the rear wall defining an air inlet, with a steel grate extending over the inlet to prevent clothing or other laundry from entering the inlet. A heater is provided in the cabinet to supply heated air through the air inlet and into the drum to facilitate drying of the laundry. One problem associated with this conventional dryer construction is that the heated air is projected forwardly into the drum. Such a forward motion on the incoming air minimizes the time that the hot air is in contact with the wet laundry before the air is exhausted adjacent the front of the drum. Therefore, the drying efficiency and drying rate are decreased. Drying rate is defined in the industry as the pounds of water removed per minute. Drying efficiency is defined in the industry as pounds of water evaporated per kilowatt hour.

Also, while the heater normally stratifies the air into a hot inner core surrounded by a cooler outer envelope, the hotter inner core passes through an air inlet grid or grate, and thus heats the grate to temperatures between 300° F. to 500° F. Such temperatures of the metal inlet grate can damage clothing and other laundry which comes into contact with the grate.

Accordingly, a primary objective of the present invention is the provision of an improved dryer having an increased drying efficiency and increased drying rate.

Another objective of the present invention is the provision of a dryer air inlet arrangement which eliminates the air inlet grate so as to prevent heat damage to clothing and laundry.

A further objective of the present invention is the provision of an improved clothes dryer which introduces heated air in a downward direction through a generally horizontally disposed air inlet in the rear bulkhead such that the air is retained within the dryer drum for a longer period of time prior to exhaust adjacent the front of the drum.

Still a further objective of the present invention is the provision of a dryer drum having a rear bulkhead with a ramped forward surface along which heated air is introduced into the drum for drying laundry therein.

A still further objective or the present invention is the provision of a clothes dryer with a drying chamber of increased volume through the use of a rear bulkhead having a spirally ramped forward surface.

Another objective of the present invention is the provision of an improved air inlet for a clothes dryer wherein the heated air is introduced into the dryer drum and is encased in a barrier of cooler air so as to minimize temperatures of the drum surfaces adjacent the air inlet.

These and other objectives of the invention will become apparent from the following description of the invention.

SUMMARY OF THE INVENTION

The improved dryer of the present invention includes a cabinet with a drum mounted inside the cabinet. The drum includes a rotatable sidewall with opposite forward and rearward ends. The forward end of the sidewall is substantially open and aligned with an access opening in the front of the cabinet over which a door is pivotally mounted. The rearward end of the sidewall is sealingly engaged by a stationary rear bulkhead mounted in the cabinet. An air inlet is provided in the rear bulkhead for introducing air into the drum. The air inlet does not include a grid or grate. An air outlet is provided adjacent the forward end of the sidewall for exhausting air from the drum.

A heater is provided for heating the air prior to introduction into the drum. The heater produces a hot inner air core and a cooler outer air envelope. The cool air envelope protects the rear bulkhead and sidewall from direct contact with the hotter inner air core upon introduction of the air into the drum. Therefore, the temperatures of the rear bulkhead and drum sidewall are maintained at relatively low levels which will not damage laundry.

The air inlet is defined by a generally horizontally disposed, substantially downwardly directed opening in the rear bulkhead. Thus, the air is introduced in a substantially downward vertical direction without a forward motion component. The rear bulkhead includes a spirally ramped surface along which the introduced air flows. The ramped surface provides a forward component to the air flow, such that the heated air is maintained within the drum for a substantially longer period than in conventional dryers. Accordingly, the drying efficiency is increased an average of 15%, while the drying rate is increased an average of 7% in a clothes dryer having a 4600 watt input as compared to other clothes dryers manufactured by the assignee of the present invention having a 5150 watt input.

DETAILED DESCRIPTION OF THE DRAWINGS

Figure 1:
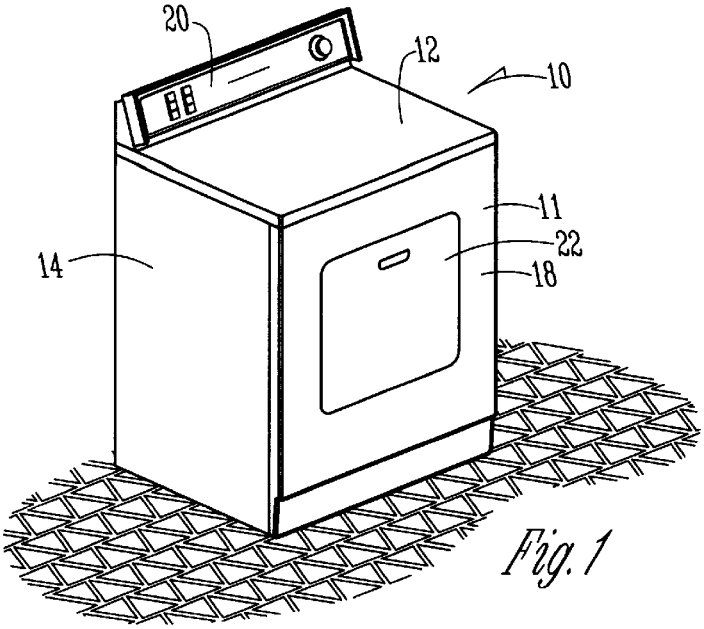
FIG. 1 is a perspective view of a laundry dryer.

With reference to the drawings, Numeral 10 generally designates a clothes and laundry dryer. The dryer cabinet 11 includes a top panel 12, opposite side panels 14, a rear panel 16, and a front panel 18. A control board 20 is provided for selecting the operations of the dryer 10. The front panel 18 includes an access opening with a door 22 pivotally mounted for movement between open and closed positions relative to the access opening.

Figure 2:
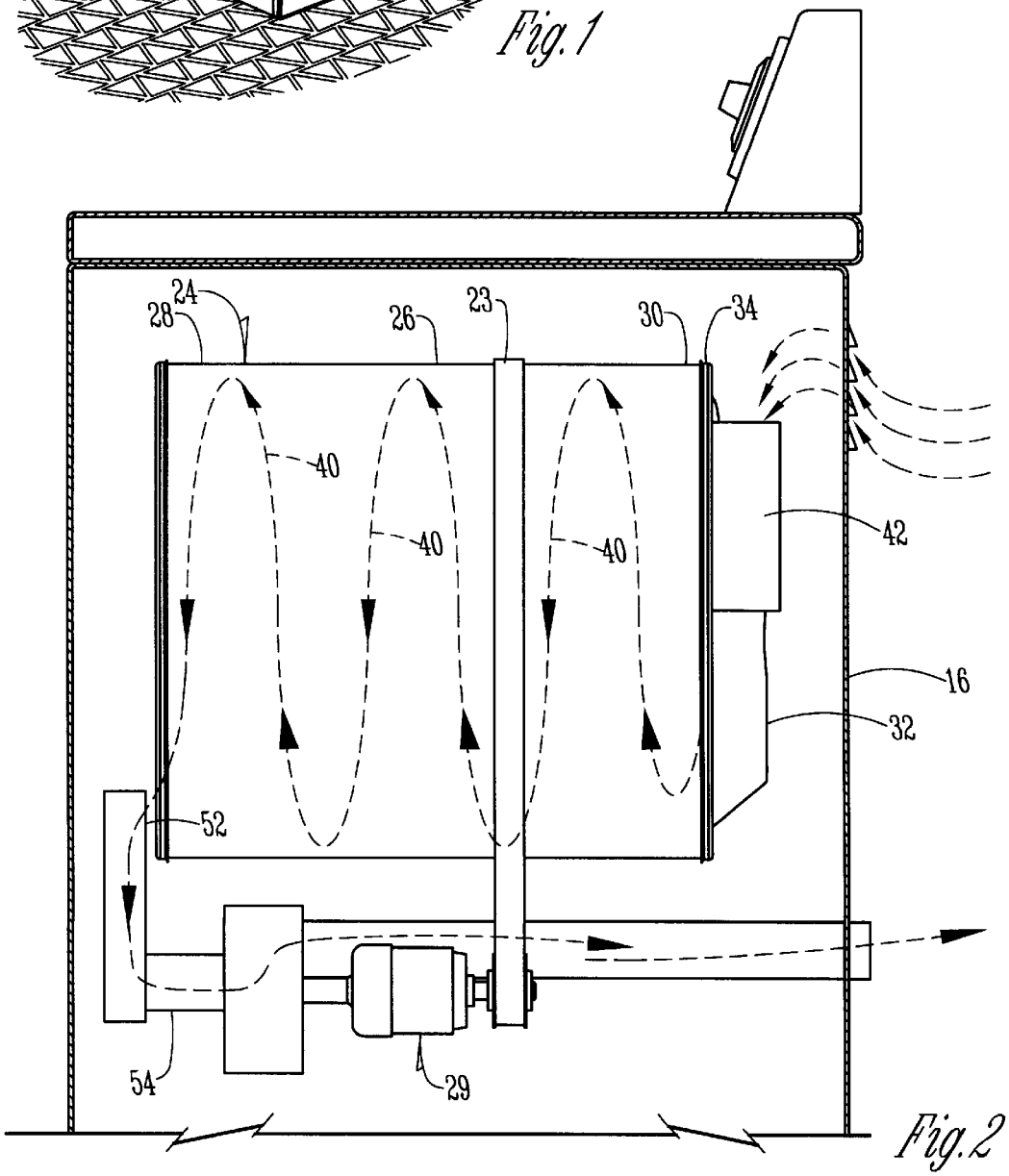
FIG. 2 is a partial side elevation sectional view of the dryer showing the dryer drum and air inlet arrangement of the present invention.

A drum 24 is provided within the cabinet 11. More particularly, the drum 24 includes a cylindrical sidewall 26 which is rotatably mounted within the cabinet 11. Generally, the sidewall 26 is rotatably supported in a manner similar to that shown and described in U.S. Pat. No. 4,854,054 issued on Aug. 8, 1989, owned by the assignee of the present invention, the disclosure of which is incorporated herein by reference. The specific structure for rotatably supporting the sidewall 26 of the drum 24 does not constitute a part of the present invention, and has not been shown in FIG. 2 for purposes of simplicity and clarity.

The sidewall 26 includes a forward end 28 and a rearward end 30. The forward end 28 is substantially open and aligned with the access opening of the cabinet 11 so as provide access into the drum 24 through the open door 22. A motor 29 and drive belt assembly 23 is provided for rotating the sidewall 26, as described in the U.S. Pat. No. 4,854,054.

Figure 3:
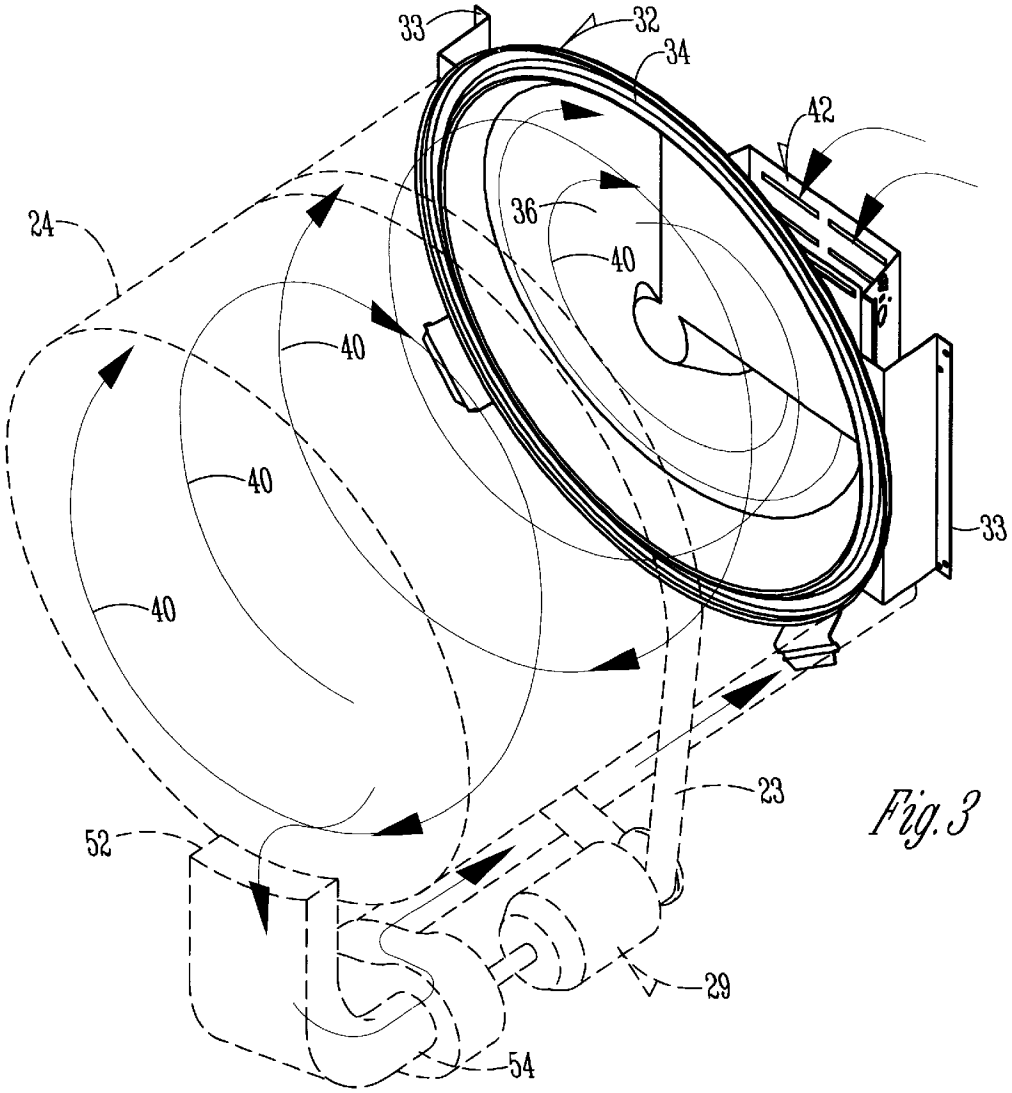
FIG. 3 is a perspective view of the rear bulkhead, with other components shown in broken lines.
Figure 4:
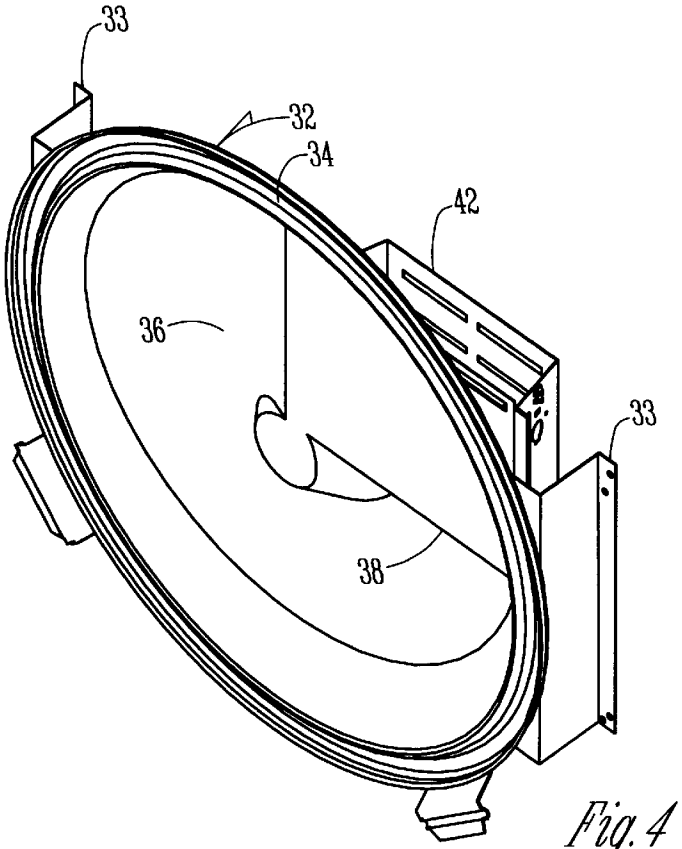
FIG. 4 is a front perspective view of the bulkhead according to the present invention.
Figure 5:
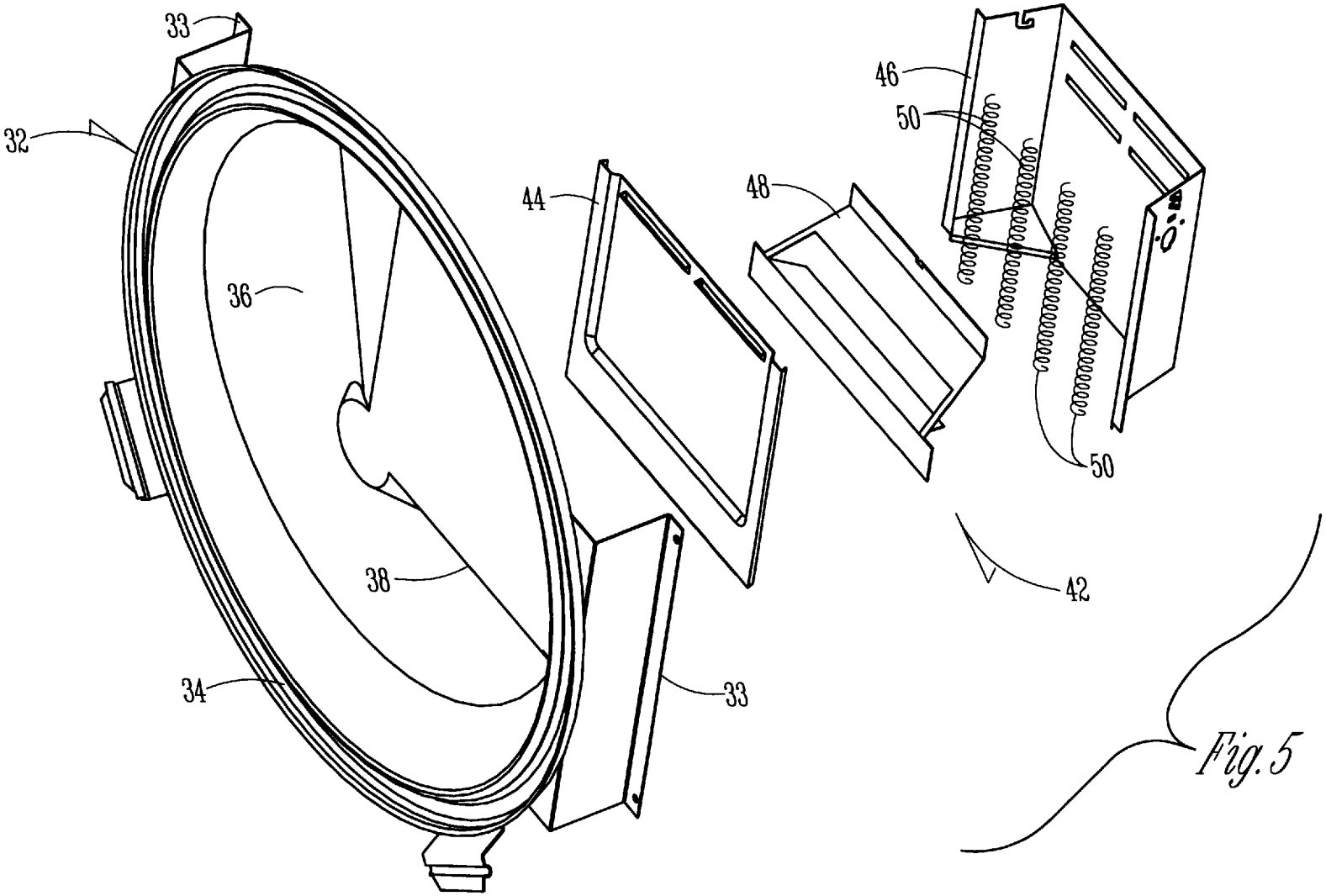
FIG. 5 is an exploded perspective view of the bulkhead and heater.
Figure 6:
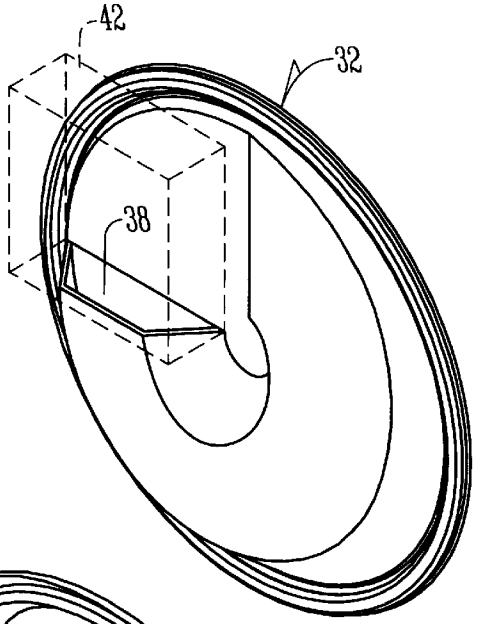
FIG. 6 is a rear perspective view of the bulkhead, with the heater shown in broken lines.
Figure 7:
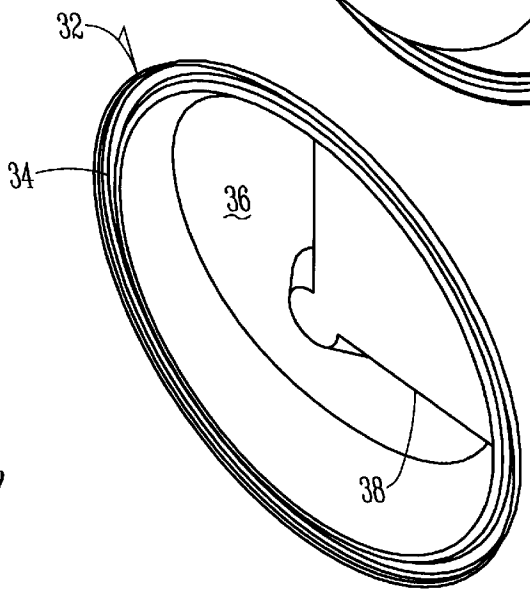
FIG. 7 is a front perspective view of the bulkhead.
Figure 10:
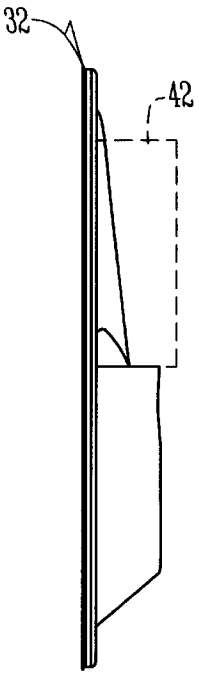
FIG. 10 is a side elevation view of the bulkhead.
Figure 9:
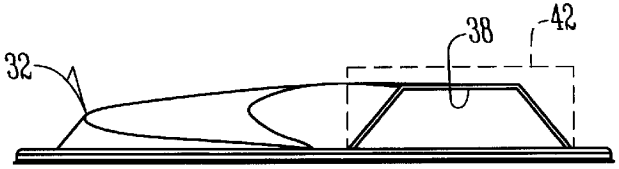
FIG. 9 is a top plan view of the bulkhead.
Figure 8:
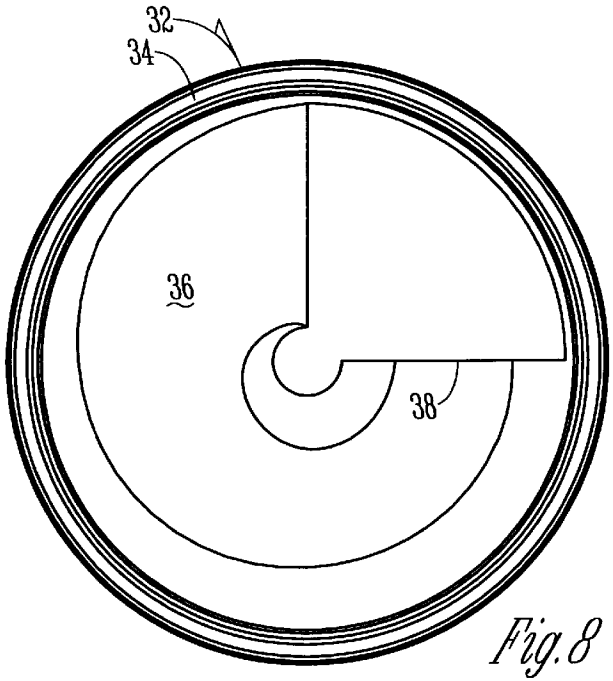
FIG. 8 is a front elevation view of the bulkhead.

The drum 24 also includes a stationary rear bulkhead 32 which is mounted within the cabinet 11 by brackets 33 shown in FIGS. 3–5. The bulkhead 32 is mounted so as to sealingly engage the rearward end 30 of the sidewall 26. A conventional sealing membrane 34, such as felt, is provided in the perimeter edge of bulkhead 32 to provide an appropriate seal with the rearward end 30 of the sidewall 26.

The bulkhead 32 includes a spirally ramped forward surface 36. As can be readily observed from the drawing figures, the spiral ramped surface 36 is rearwardly depressed or embossed to effectively elongate the sidewall 26 and provide for increased volume of approximately ¼ cubic foot in the drying chamber of the dryer 10 as defined by the sidewall 26 and the bulkhead 32. In the preferred embodiment, an air inlet opening 38 is provided in the bulkhead 32 at a 3 o'clock position therein. The air inlet opening 38 comprises a generally horizontally disposed, substantially downwardly directed opening recessed from the rear of the drum 24 such that drying air can be introduced into the drum 24 in a substantially downward vertical direction for movement along the ramped surface 36. It is noted that no air inlet grate is provided over the air inlet opening 38. A conventional air inlet grate is not required since the air inlet opening 38 is substantially downwardly facing and does not rotate, since the rear bulkhead 32 is fixed. With the sidewall 26 rotating in a clockwise direction, as viewed in FIG. 3, gravity prevents clothes from moving upwardly through the air inlet opening 38. The spiral ramped surface 36 of the rear bulkhead 32 also tends to direct clothing and laundry forwardly, away from the air inlet opening 38. The drawing figures show the preferred embodiment with the air inlet 38 located at the 3 o'clock position as viewed from the front of the dryer 10. It is further envisioned that this air inlet 38 can also be located in various other angular positions especially between the 12 o'clock and 6 o'clock locations and that the spirally ramped forward surface 36 can be rotated correspondingly to provide an air inlet 38 that allows the drying air to enter the drying chamber in a substantially downward direction obviating the need for an inlet grate.

A heating unit 42 is mounted on the rearward side of the rear bulkhead 32. As best seen in FIG. 5, the heating unit 42 includes an inner housing 44, an outer housing 46, an air deflection baffle 48, and a plurality of heating coils 50. The top and bottom of the heating unit 42 are open to permit air flow downwardly through the heating unit 42 for heating by the coils 50. In operation, as a column of air passes through the heating unit 42, the coils 50 heat an inner core of the air column while an outer envelope of a cooler temperature surrounds the hotter inner core. Thus, a cool air barrier or jacket is formed around the hot inner air core for introduction into the drum 24 through the air inlet opening 38. The envelope or jacket of cool air prevents direct contact between the hot inner core of the air column and the surfaces of the inner housing 44, outer housing 46 and the rear bulkhead 32, thereby minimizing the temperatures of those surfaces.

In the present invention, the surfaces of the cylinder sidewall 26 and the bulkhead 32 adjacent the air inlet 38 have been measured at temperatures below 229° F. In comparison, in our production dryer wherein the air is introduced into the drum in a generally horizontal direction through a metal cover grate over the inlet opening, the grate temperature typically ranges between 300° F. to 500° F. due to the grate being directly contacted by the hot inner air core. Therefore, the present invention eliminates excessive surface temperatures which can cause damage to clothing and laundry contained in the drum 24 since there is no air inlet grate that the heated air must flow through.

The heated drying air is introduced through the air inlet 38 into the drum 24 in a substantially vertical downward direction and without any substantial forward motion. The air then travels along the spirally ramped forward surface 36 of the bulkhead 32, which imparts a slight forward motion to the air flow. The heated air thus spirals through the drum 24, as generally shown by arrows 40 in FIG. 3, until the air is exhausted through an outlet opening 52 adjacent the forward end 28 of the sidewall 26. An exhaust conduit 54 directs the air to a vent (not shown) exterior to the dryer 10.

Since the air flow through the drum 24 has a relatively small forward motion component, as compared to conventional dryers wherein the air is introduced in a horizontal direction with a substantial forward motion component, the present invention achieves a better mix of the heated air with the clothing for a longer period of time for a set volume of air introduced into the drum 24. It has been noted that, the drying efficiency of the dryer 10 is increased an average of 15% and the drying rate is increased an average of 7% in a clothes dryer having a 4600 watt input as compared to other clothes dryers manufactured by the assignee of the present invention having a 5150 watt input.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A laundry dryer comprising:

a cabinet having a top panel, a rear panel, opposite side panels, and a front panel with an access opening;

a door pivotally mounted on the front panel for movement between open and closed positions relative to the access opening;

a drum having a cylindrical sidewall rotatably mounted within the cabinet, with a substantially open forward end aligned with the access opening and a rearward end;

a stationary rear bulkhead mounted in the cabinet for sealing engagement over the rear end of the drum sidewall;

a generally downwardly directed air inlet in the rear bulkhead recessed from the rear end of the drum for introducing air into the drum in a substantially downwardly directed flow; and an air outlet adjacent the forward end of the drum.

2. The dryer of claim 1 wherein the rear bulkhead includes a spirally ramped forward surface.

3. The dryer of claim 2 wherein the air inlet directs air along the ramped forward surface of the bulkhead.

4. The dryer of claim 2 wherein the spirally ramped forward surface of the rear bulkhead is at least partially rearwardly depressed to effectively elongate the drum sidewall.

5. The dryer of claim 2 wherein the air inlet is positioned between the 12 o'clock and 6 o'clock locations in the rear bulkhead.

6. The dryer of claim 1 further comprising a heater mounted on the rear bulkhead for heating air prior to introduction into the drum.

7. The dryer of claim 6 wherein the heater produces an inner core of hot air and an outer envelope of cool air, and the air inlet being free from structure blocking the hot air inner core.

8. The dryer of claim 1 wherein the downwardly directed air inlet allows air to be introduced into the drum in a substantially vertical direction.

9. The dryer of claim 8 wherein the air inlet is free from any covering grate structure.

10. The dryer of claim 1 wherein the air inlet comprises a generally horizontally disposed opening such that air is introduced into the drum in a substantially vertical direction.

11. The dryer of claim 10 wherein the opening is directed downwardly.

12. An improved laundry dryer including a cabinet having a top panel, a rear panel, opposite side panels, a front panel with an access opening, and a door pivotally mounted on the front panel for movement between open and closed positions relative to the access opening, the improvement comprising:

a drum having a cylindrical sidewall rotatably mounted within the cabinet, with a substantially open forward end aligned with the access opening and a rearward end;

a rear bulkhead sealingly covering the rearward end of the drum sidewall;

a heater for heating for air, the heater producing a hot inner air core and a cool outer air envelope surrounding the inner air core;

an air inlet in the rear bulkhead for introducing air from the heater into the drum, the air inlet being free from any structure directly contacting the inner air core; and an air outlet adjacent the forward end of the drum.

13. The improved laundry dryer of claim 12 wherein the rear bulkhead includes a spirally ramped forward surface for guiding the air from the air inlet moves.

14. The improved laundry dryer of claim 13 wherein the spirally ramped forward surface of the rear bulkhead is at least partially rearwardly depressed to effectively elongate the drum sidewall.

15. The improved laundry dryer of claim 13 wherein the air inlet is positioned between the 12 o'clock and 6 o'clock locations in the rear bulkhead.

16. The improved laundry dryer of claim 13 wherein the air inlet is directed substantially downwardly such that air is introduced into the drum in a substantially vertical direction.

17. The improved laundry dryer of claim 13 wherein the air inlet comprises a generally horizontally disposed opening such that air is introduced into the drum in a substantially vertical direction.

18. An improved laundry dryer including a cabinet having a top panel, a rear panel, opposite side panels, a front panel with an access opening, and a door pivotally mounted on the front panel for movement between open and closed positions relative to the access opening, the improvement comprising:

a drum having a cylindrical sidewall rotatably mounted within the cabinet, with a substantially open forward end aligned with the access opening and a rearward end;

a rear bulkhead sealingly covering the rearward end of the drum sidewall, and having a ramped forward surface;

a generally downwardly directed air inlet positioned between the 3 o'clock and 6 o'clock locations in the lower half of the rear bulkhead for introducing air from the heater into the drum along the ramped forward surface of the bulkhead; and an air outlet adjacent the forward end of the drum.

19. The improved laundry dryer of claim 18 wherein the ramped forward surface of the rear bulkhead is at least partially rearwardly depressed for effectively elongating the drum sidewall.

20. The improved laundry dryer of claim 18 further comprising a heater mounted on the rear bulkhead for heating air prior to introduction into the drum.

21. The improved laundry dryer of claim 20 wherein the heater produces an inner core of hot air and an outer envelope of cool air, and the air inlet being free from structure blocking the hot air inner core.

22. The improved laundry dryer of claim 18 wherein the air inlet is directed downwardly such that air is introduced into the drum in a substantially vertical direction.

23. The improved laundry dryer of claim 21 wherein the air inlet is free from any covering grate structure.

24. The improved laundry dryer of claim 18 wherein the air inlet comprises a generally horizontally disposed opening such that air is introduced into the drum in a substantially vertical direction.

* * * * *